US005156300A

United States Patent [19]

Spahni et al.

[11] Patent Number: 5,156,300

[45] Date of Patent: Oct. 20, 1992

[54] BAG-IN-SQUEEZE-BOTTLE FLUID DISPENSER WITH UNSEALED FLUID PASSAGE

[75] Inventors: Milton D. Spahni, Okeana; Ronald W. Kock, Wyoming; Charles G. Yeazell, Cincinnati; Robert C. Johnson, Okeana, all of Ohio

[73] Assignee: The Procter & Gamble Company, Cincinnati, Ohio

[21] Appl. No.: 787,693

[22] Filed: Nov. 1, 1991

Related U.S. Application Data

[63] Continuation of Ser. No. 483,609, Feb. 22, 1990, abandoned.

[51] Int. Cl.[5] ..... B65D 35/56

[52] U.S. Cl. ..... 222/105; 222/211; 222/212; 222/464; 222/491

[58] Field of Search ..... 222/92–95, 222/105, 107, 209–215, 490, 491, 464, 131, 145, 183, 386.5; 383/33, 905

[56] References Cited

U.S. PATENT DOCUMENTS

| | | | |
|---|---|---|---|
| Re. 32,383 | 3/1987 | Banks et al. | 53/449 |
| 1,457,895 | 6/1923 | Campanella . | |
| 2,608,320 | 8/1952 | Harrison, Jr. | 222/95 |
| 2,804,240 | 8/1957 | Anderson | 222/212 X |
| 2,859,899 | 11/1958 | Kramer et al. | 222/95 |
| 3,240,399 | 3/1966 | Frandeen | 222/211 |
| 3,245,582 | 4/1966 | Roth et al. | 222/4 |
| 3,486,661 | 12/1969 | Friedrich et al. | 222/95 |
| 3,493,179 | 2/1970 | Lee | 222/211 X |
| 3,587,937 | 6/1971 | Childs | 222/213 |
| 3,592,365 | 7/1971 | Schwartzman | 222/209 |
| 3,648,903 | 3/1972 | Marchant | 222/212 |
| 3,709,437 | 1/1973 | Wright | 239/343 |
| 3,726,436 | 4/1973 | Despain et al. | 222/213 |
| 3,896,970 | 7/1975 | Laauwe | 222/94 |
| 3,973,701 | 8/1976 | Gardner | 222/190 |
| 4,013,195 | 3/1977 | Ferris | 222/211 X |
| 4,020,978 | 5/1977 | Szczepanski | 222/209 |
| 4,057,177 | 11/1977 | Laauwe | 222/215 |
| 4,062,475 | 12/1977 | Harris et al. | 222/95 |
| 4,087,023 | 5/1978 | Szczepanski | 222/211 X |
| 4,098,434 | 7/1978 | Uhlig | 222/94 |
| 4,138,036 | 2/1979 | Bond | 222/464 X |
| 4,139,124 | 2/1979 | Ferrante | 222/110 |
| 4,147,306 | 4/1979 | Bennett | 239/327 |
| 4,154,366 | 5/1979 | Acres | 222/95 |

(List continued on next page.)

FOREIGN PATENT DOCUMENTS

| | | | |
|---|---|---|---|
| 961015 | 1/1975 | Canada . | |
| 0182094 | 5/1986 | European Pat. Off. . | |
| 8600868 | 2/1986 | PCT Int'l Appl. | 222/105 |

*Primary Examiner*—Michael S. Huppert
*Assistant Examiner*—Kenneth DeRosa
*Attorney, Agent, or Firm*—Richard C. Witte; E. Kelly Linman; Michael E. Hilton

[57] ABSTRACT

A bag in squeeze bottle fluid dispenser capable of dispensing substantially all of the fluid product contained therein. A suitable bag support element is inserted inside the flexible bag to prevent substantial axial movement of the bag in the direction of its discharge orifice and to encourage radial collapse of the bag instead. The internal bag support means, which in a preferred embodiment comprises an extruded plastic helix, has an internal fluid passage formed within the coils of the helix and fluid communication to allow fluid contained within the bag to access the internal fluid passage along substantially the entire length of the internal bag support element. Thus, radial collapse of the flexible bag does not block the passage of fluid remaining in the bag through the discharge orifice in the bag until substantially all of the fluid contained within the bag has been dispensed. In a particularly preferred embodiment, the internal bag support element is inserted into the dispenser through the discharge orifice of the bag to a point substantially coinciding with the opposite end of the flexible bag after the bag has been filled with the fluid to be dispensed.

22 Claims, 8 Drawing Sheets

U.S. PATENT DOCUMENTS

| | | | |
|---|---|---|---|
| 4,159,790 | 7/1979 | Bailey | 222/211 X |
| 4,286,636 | 9/1981 | Credle | 141/65 X |
| 4,286,735 | 9/1981 | Sneider | 222/211 X |
| 4,295,582 | 10/1981 | Acres | 222/213 |
| 4,322,020 | 3/1982 | Stone | 222/95 |
| 4,340,157 | 7/1982 | Darner | 222/215 X |
| 4,428,508 | 1/1984 | Gardikas et al. | 222/211 X |
| 4,469,250 | 9/1984 | Evezich | 222/83.5 |
| 4,513,891 | 4/1985 | Haine et al. | 222/213 |
| 4,562,942 | 1/1986 | Diamond | 222/386.5 |
| 4,620,648 | 11/1986 | Schwartzman | 222/490 |
| 4,730,751 | 3/1988 | Mackles et al. | 222/189 |
| 4,785,974 | 11/1988 | Rudick et al. | 222/211 X |
| 4,809,884 | 3/1989 | Stackhouse | 222/153 |
| 4,842,165 | 6/1989 | Van Coney | 222/95 |
| 4,865,224 | 9/1989 | Streck | 222/95 |
| 4,936,490 | 6/1990 | Battegazzore | 222/211 X |
| 4,949,871 | 8/1990 | Flanner | 222/95 |

BAG-IN-SQUEEZE-BOTTLE FLUID DISPENSER WITH UNSEALED FLUID PASSAGE

This is a continuation of application Ser. No. 07/483,609, filed on Feb. 22, 1990 now abandoned.

TECHNICAL FIELD

The present invention relates to fluid dispensers and more particularly to squeeze-bottle dispensers having collapsible, fluid-containing bags therein. Even more particularly, the present invention relates to means for resisting the collapse of a fluid-containing bag near the discharge end of a bag-in-squeeze-bottle fluid dispenser.

The present invention further relates, in a particularly preferred embodiments, to such means which can be readily inserted within the collapsible, fluid-containing bag after the bag has been filled with the fluid to be dispensed.

BACKGROUND ART

Prior art flexible walled bottles, which are manually deformable to decrease their inner volumes so as to force out the contents thereof, are known as squeeze-bottles. When the deformed bottle wall is released, it is designed to be self-restoring to its undeformed condition. As the bottle is emptied of its fluid, air is drawn into the bottle to replace the fluid. The fluid being dispensed is typically incompressible and heavier than air. When the bottle is set upright on its base, the fluid flows to the bottom of the bottle. If a nearly empty squeeze-bottle remains substantially upright, no fluid is dispensed when it is squeezed, since air is first pumped out and then sucked back into the bottle. If the same bottle is inverted, and the fluid is resistant to flow, the fluid remains inaccessible until it has had time to flow from the bottom of the bottle to substantially block the bottle's discharge opening. Only then does squeezing the bottle compress air behind the fluid and force it out of the discharge opening. The wait may be quite inconvenient, especially when fluids resistant to flow are residing in nearly empty, tall bottles. In extreme cases, gravity alone does not enable such a fluid to flow to the discharge opening in the bottle.

Consequently, consumers have recognized the need for an "always ready to dispense" squeeze-bottle for flow resistant fluids. One known means for satisfying that need involves the addition of a collapsible fluid-containing bag inside a squeeze-bottle. Streck U.S. Pat. No. 4,865,224 and Uhlig U.S. Pat. No. 4,098,434 disclose such structures. When a fluid-containing bag is sealingly secured to the discharge end of such a squeeze-bottle, air is trapped between the inside of the squeeze-bottle and the outside of the bag. This air is compressed when the bottle is subsequently squeezed. Air pressure is thereby transmitted to the bag, causing the bag to discharge its fluid. Compression of the air trapped between the inside of the squeeze bottle and the outside of the bag can be accomplished by blocking a vent hole in the squeeze bottle with a finger or by providing the squeeze bottle with a one-way vent valve.

When a bag-in-squeeze-bottle dispenser functions properly, successive squeezes of the bottle cause the bag inside to collapse around the decreasing volume of fluid remaining in the bag. However, the "always ready to dispense" benefit is not automatically realized in prior art bag-in-squeeze-bottle dispensers unless the bag is prevented from collapsing upon itself near the discharge opening. Unless means are provided to prevent the premature choking off of fluid flow, not only will the "always ready to dispense" benefit be lost, but a significant volume of fluid will remain completely inaccessible within the bag. This causes the consumer to either waster the fluid product remaining within the dispenser or go to the trouble of manually breaking the package open to access the fluid product remaining therein. Neither of these alternatives are acceptable to most consumers.

Although it is believed that air pressure developed around the outside of the flexible bag by squeezing of the outer container is uniformly distributed in prior art bag-in-squeeze-bottle packages, it has been observed that, if left unsecured to the outer container, the flexible bag tends to first collapse on itself at its discharge end regardless of the dispenser's orientation. When the bottle is inverted, the unconstrained bag is free to slump toward the discharge end where its folds may further aggravate this fluid flow choking problem. Accordingly, one object of the present invention is to prevent the collapse of a fluid-containing bag in a squeeze-bottle in order to avoid disruption of fluid discharge until substantially all of the fluid has been dispensed from the bag.

Prior art attempts to solve this problem have involved securement of the bottom end of the bag to the bottom end of the container to force the bag to collapse in an inwardly radial direction. However, solutions of this type have proven difficult to implement. In addition, they have not proved completely effective, since the uppermost portion of the bag may still prematurely collapse and prevent fluid product in the lowermost portions of the bag from reaching the bag's discharge orifice.

Another means of preventing such premature collapse of the fluid-containing bag is by securing the bag to the inner sidewall of a squeeze-bottle approximately midway along the longitudinal axis of the bottle. Such constraint is intended to cause the bag to collapse in a predictable fashion, i.e., the bag inverts substantially about its mid-point securement and thereby avoids the fluid choking problem.

Harrison U.S. Pat. No. 2,608,320 discloses a squeezable container having a cylindrical bag cartridge consisting of both a flexible lower cylinder half and a rigid upper cylinder half. The discharge end of the dispenser is at the upper end of the rigid half. The fluid-containing bag requires connection to the lowermost end of the rigid portion of the container. This design provides controlled bag collapse by inversion of the flexible portion of the bag into the rigid portion of the container.

One difficulty associated with squeeze bottles employing such invertible bags is that it may be difficult to readily gain the access needed to secure the flexible bag and the outer container to one another at the desired predetermined points. To provide suitable access for the sealing tools may negatively impact dispenser production speeds or impose design limitations on the shape of the dispenser.

Another difficulty with squeeze bottles employing such invertible bags is that when a bag inverts axially upward relative to the base of the container, the uppermost end of the container becomes heavier, thereby requiring a relatively wide base to maintain stability against tipping toward the end of the dispenser's life cycle. This factor tends to limit design flexibility in terms of the shape of the outer container.

Accordingly, it is another object of the present invention to provide a bag-in-squeeze-bottle fluid dispenser which can be reliably manufactured and filled at high speed and which overcomes many of the aforementioned problems and/or design limitations inherent in prior art bag-in-squeeze-bottle dispensers.

DISCLOSURE OF THE INVENTION

To provide maximum flexibility for squeeze-bottle shape and design, it has been found desirable to substantially limit bag collapse axially upward and to encourage radial bag collapse instead.

However, to minimize the difficulty of implementation, no attempt is made to secure any portion of the flexible bag to the bottom or sidewalls of the flexible squeeze-bottle. Rather, it has been found that suitable support means can be inserted inside the flexible bag, said support means extending from the discharge orifice of the container substantially to the bottom of the bag. The internal bag support means substantially prevents the bottom of the bag from moving in the direction of the discharge orifice when the dispenser is inverted and product is dispensed.

The bag support means preferably comprises a three-dimensional structure having at least one internal fluid passageway extending along its entire length and exhibiting a relatively high open area long its entire length. The high open area of the bag support means makes it nearly impossible for the radially collapsing flexible bag to completely block the flow of fluid product from within the bag into the internal passageway defined by the bag support means and ultimately out the discharge orifice of the dispenser, at least until the bag has been substantially emptied.

In a particularly preferred embodiment of the present invention, the internal bag support means is inserted through the discharge orifice of the dispenser after the flexible bag has been inserted into the bottle, the bag's discharge orifice has been secured in sealed relation to the discharge orifice of the bottle and the bag has been filled with the fluid product to be dispensed. This eliminates any possible interference of the internal bag support means with the filling operation and permits relatively high speed handling of dispensers of the present invention by the manufacturer during the filling, support inserting and closure applying operations.

In a particularly preferred embodiment, the objects of the present invention are achieved by employing an open helix structure as an internal bag support means in a bag-in-squeeze-bottle fluid dispenser of the present invention. A preferred dispenser comprises: an outer container or bottle having at least one resiliently deformable sidewall and an open discharge end comprising a discharge orifice which is normally located within the container's finish; a fluid-containing flexible bag housed within the outer container and having a discharge orifice secured in sealed relation across the discharge orifice of the outer container; vent means in communication with the space between the outer container and the flexible bag, the vent means being capable of forming a seal to the atmosphere to permit the application of air pressure to the flexible bag by squeezing the resiliently deformable sidewall of the outer container and venting of the space between the flexible bag and the outer container to atmosphere when the resiliently deformable sidewall is released; and internal bag support means extending from the discharge orifice of the flexible bag substantially to the bottom of the flexible bag for resisting the collapse of the bag near its discharge end as well as along substantially its entire length. The internal bag support means enables fluid from all regions of the bag to reach the discharge orifice of the bag with minimum flow restriction until substantially all of the fluid has been dispensed from the flexible bag.

The particular manner in which the bag is secured in sealed relation to the discharge orifice of the outer container is non-critical in the practice of the present invention. The same is true with respect to the particular manner in which the internal bag support means is secured within the flexible bag of the dispenser. However, in its most preferred form, the internal bag support means disclosed herein can be inserted through the discharge orifice of the dispenser after the filling operation has been completed. Thus, bag-in-squeeze-bottle fluid dispensers of the present invention can readily be filled with fluid product at high speed using filling nozzles which penetrate the discharge orifice of the dispenser during the filling operation without any interference from the internal bag support means.

In a particularly preferred embodiment of the present invention, a hollow stepped tube to which the discharge orifice of the flexible bag is sealingly secured includes an internal fluid passage through which the bag support may be axially slid after the filling operation has been completed. This passage provides fluid communication from the discharge orifice of the flexible bag through the discharge orifice of the squeeze bottle. The bore in the hollow stepped tube is preferably sized to substantially coincide with the external cross-section of the internal support means and is of sufficient length that the internal bag support means is precluded from substantial lateral movement after it has been fully inserted substantially to the bottom of the flexible bag. The bottom of the flexible bag will substantially prevent the internal bag support means from becoming dislodged inside the container, since the length of the bag will limit the axial penetration of the bag support means throughout the life of the dispenser. If desired, the internal bag support may also be prevented from moving axially out of the dispenser by securing an ancillary retaining member, a product discharge valve or both across the discharge orifice of the hollow stepped tube. Thus, the internal bag support means is unsealingly held within the passage in the hollow stepped tube or housing.

Several alternative means for resisting bag collapse may be employed in practicing the present invention. One particularly preferred means comprises an extruded plastic helix with a pitch equal to about half of its diameter. The ratio of helix diameter to extrusion diameter generally determines the flexibility of such an extruded plastic helix. A flexible helix which not only bends as the bottle is tilted, but which also compresses to a limited degree to permit the bag to collapse axially somewhat when the dispenser is inverted is particularly preferred. Allowing a limited, but controlled degree of axial collapse in the flexible bag allows the bag to maintain a greater axial cross-section for a longer portion of the dispenser's life cycle. Thus, contact between the flexible bag and the longitudinally extending portions of the internal bag support means is not generally made until a substantial portion of the dispenser's fluid contents has been discharged. The high open area of the helix along with its longitudinal and axial flexibility normally results in very small amounts of residual fluid being left within the thin flexible bags employed in dispensers of the present invention when the package's useful life is at an end.

Another preferred internal bag support means comprises a spline having multiple open channels extending substantially the length of the bag. In a particularly preferred embodiment if comprises an extruded plastic spline with 3 to 6 radial webs cantilevered from a centrally located cylindrical member. The radial webs prevent collapse of the flexible bag against the centrally located cylindrical member. Thus, fluid is free to enter and pass along each channel between adjacent webs when the resiliently deformable sidewall of the outer container is squeezed. This particular alternative is believed to be one of the least expensive bag collapse resisting means to fabricate.

Another preferred internal bag support means suitable for practicing the present invention comprises an extruded plastic scrim tube, which like the helix, has some structural flexibility as well as high open area.

Still another preferred internal bag support means comprises a flexible plastic conduit having a multiplicity of apertures extending substantially along its entire length.

In a particularly preferred embodiment of the present invention the means for securing the bag in sealed relation to the discharge orifice in the outer container comprises a substantially rigid, hollow stepped tube or housing having an outermost surface which is sealingly secured in the discharge orifice of the outer container. The smaller diameter lowermost portion of the stepped tube includes a circumferential groove for retaining an elastic band. The open end or neck portion of the bag containing the bag's discharge orifice slips over the smaller lowermost end of the stepped tube, and the elastic band sealingly gathers the bag's discharge orifice into the groove. The bag and stepped tube are preferably preassembled while the bag is in a collapsed or folded state and thereafter inserted through the discharge orifice of the outer container as an assembly prior to filling. The collapsed or folded bag is thereafter expanded by a gas pressure pulse introduced through the fluid passage in the stepped tube.

Since the sealed bag/stepped tube connection is inside the container when the dispenser is in use, any pressure applied to the bag by squeezing the outer container is also applied across this connection between the flexible bag and the stepped tube. Thus, once sealed the bag/stepped tube connection remains leak-tight regardless of how much pressure is applied by squeezing the outer container.

In a particularly preferred embodiment a bag-in-squeeze-bottle dispenser of the present invention further comprises a one-way fluid discharge valve to prevent or at least control the volume of outside air being sucked back into the fluid-containing bag when the squeezing forces are removed from the squeeze bottle.

BRIEF DESCRIPTION OF THE DRAWINGS

While the specification concludes with claims that particularly point out and distinctly claim the subject matter regarded as forming the present invention, it is believed that the invention will be better understood from the following detailed description with reference to the drawings in which:

DETAILED DESCRIPTION OF THE INVENTION

Figure 1:
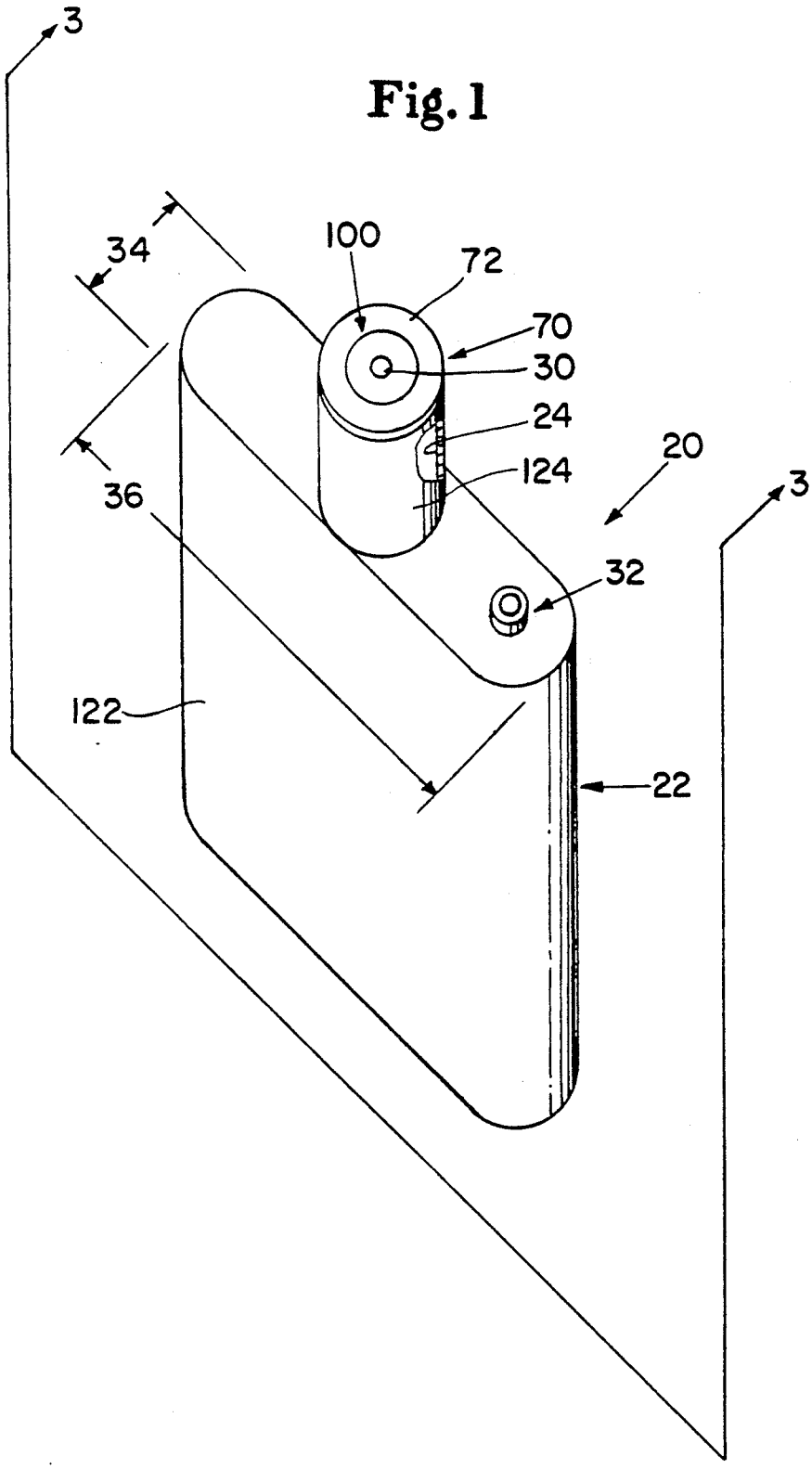
FIG. 1 is a greatly simplified schematic perspective view of a non-round bag-in-squeeze-bottle fluid dispenser of the present invention taken from its discharge end.

Referring now to the drawings, and more particularly to FIG. 1, there is shown a preferred bag-in-squeeze-bottle fluid dispenser embodiment of the present invention, generally indicated as 20. Bag-in-squeeze-bottle dispenser 20 comprises a squeeze-bottle 22 having flexible sidewalls 122; a discharge orifice 24 located within finish 124; and plug 100, having a discharge opening 30. Discharge opening 30 is preferably between about 0.100 inches and about 0.300 inches in diameter, depending on the flow resistance of the fluid to be dispensed and the normal dosage volume. Because of the relatively small size of discharge opening 30, plug 100 is normally inserted into the discharge orifice 24 of squeeze bottle 22 after fluid filling in order to provide maximum clearance for the filling nozzle.

The flexible container comprising squeeze-bottle 22 is preferably oval in cross-section having a minor axis 34 and major axis 36. Although the present invention functions irrespective of squeeze-bottle shape, it is believed that an oval bottle provides the greatest internal volume displacement for a given sidewall deflection. For example, a 6 oz. oval bottle with major/minor axis ratio of 1.9 has a displacement of 21 percent of its total volume when its sidewalls are squeezed 0.75 inches; whereas a round bottle with similar volume has a displacement of only 6 percent of its total volume with the same squeeze deflection.

The greater the volume displacement per unit of deflection of the squeeze-bottle's sidewalls, the lower will be the deflection needed for a given dose of fluid to be dispensed. Since squeeze force generally increases with deflection, and low squeeze force is in most instances preferred, lower sidewall deflection for a desired dose has also been found to be generally preferred. Although maximizing the major/minor axis ration of the oval will also maximize the volume of fluid dispensed for a given deflection of the sidewalls, this ratio is normally limited by other practical considerations, such as bottle toppling stability, bottle forming considerations, and overall aesthetics. The preferred oval squeeze-bottle major/minor axis ration used in practicing the present invention preferably ranges from about 1.1 to about 3.0, and most preferably from about 1.5 to about 1.9.

The bottle finish 124 of squeeze-bottle 22 normally includes some type of securement means (now shown) on its outermost surface for securing a removable closure (also not shown) thereto, e.g., screw threads, grooves, bosses, etc. Which mate with a complementary fastening feature on the closure.

FIG. 1 shows the uppermost flange 72 of hollow stepped tube 70. The flange 72 helps to seal first cylindrical surface 74 of stepped tube 70 within the discharge orifice 24 in finish 124 of squeeze-bottle 22. Hollow stepped tube 70 is more fully illustrated in FIGS. 2 and 3. Stepped tube 70 is preferably a substantially rigid cylindrical housing and can be formed of plastic by injection molding to provide accurate dimensional tolerances. Its primary purpose is to provide a suitable means for connecting various parts employed within dispenser 20 in sealed relation to one another and to the discharge orifice 24 in finish 124 of squeeze-bottle 22.

Figure 2:
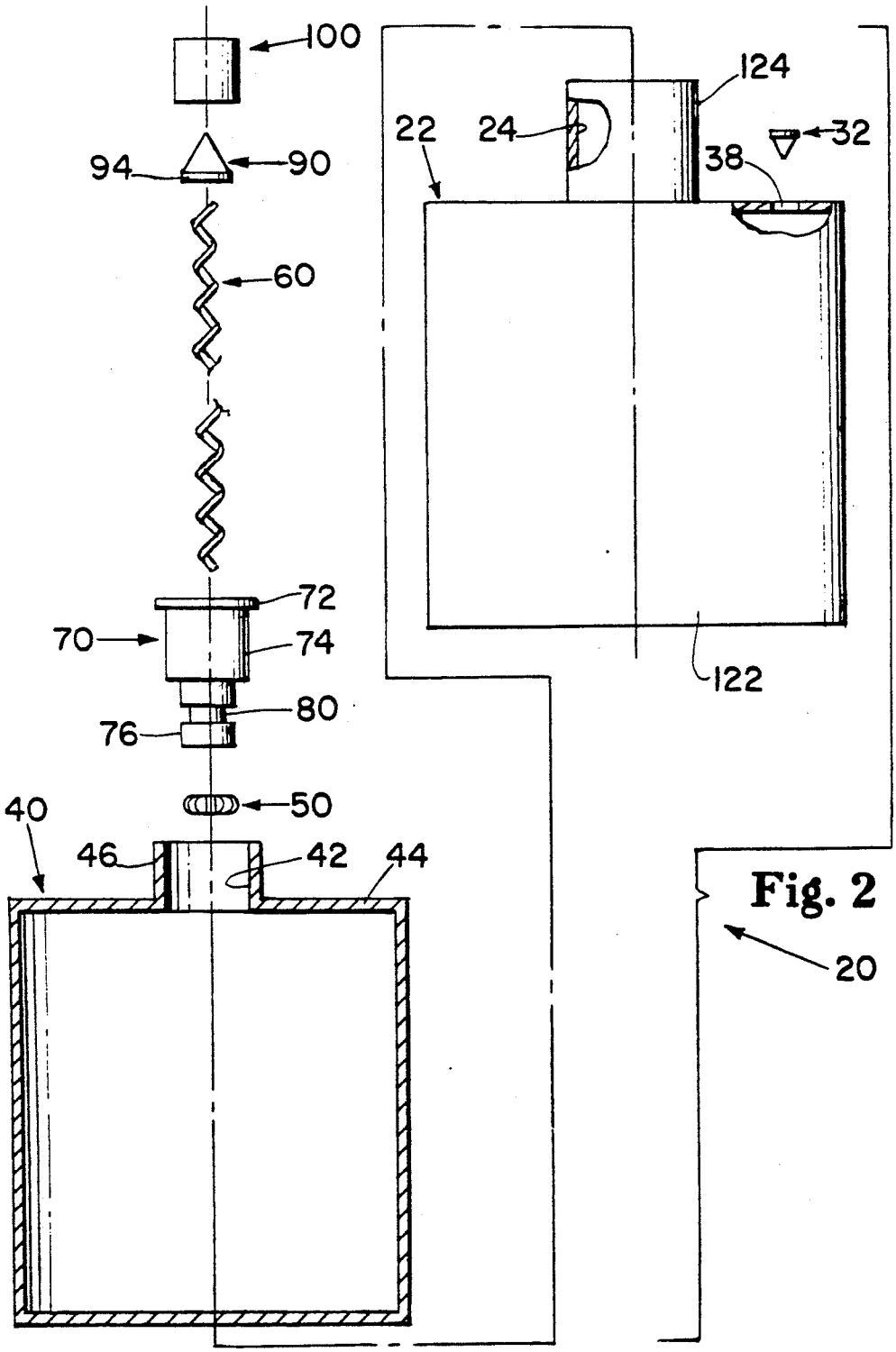
FIG. 2 is a greatly simplified schematic exploded elevation view of the bag-in-squeeze-bottle dispenser of FIG. 1, showing the various components which are contained inside the squeeze-bottle shown in FIG. 1.
Figure 3:
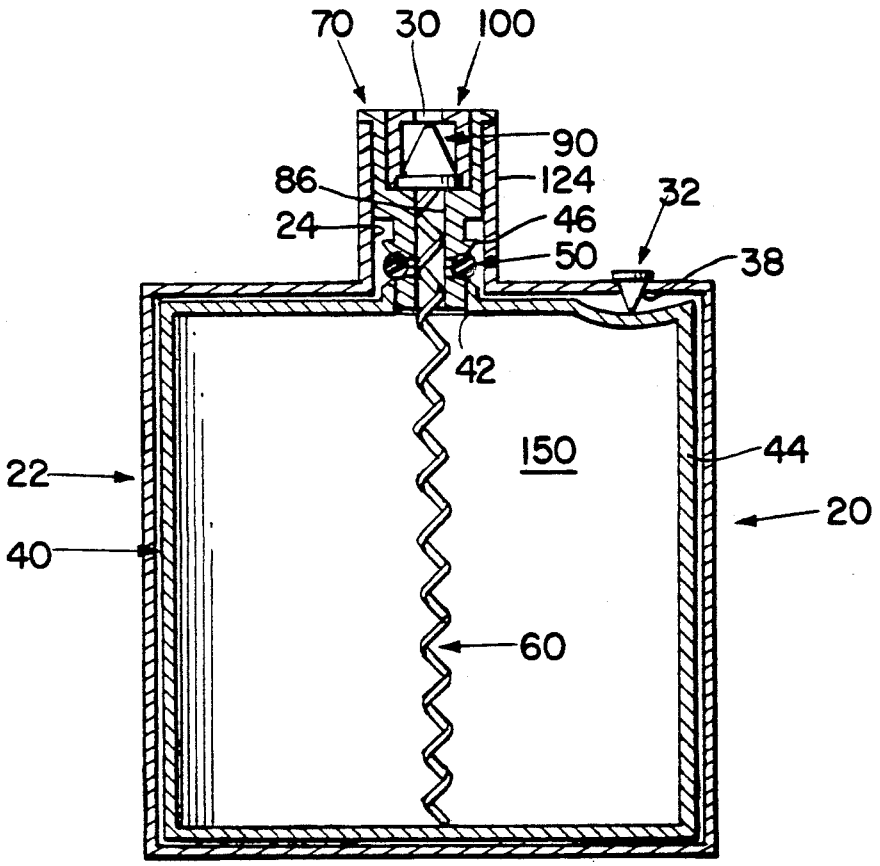
FIG. 3 is a greatly simplified schematic cross-sectional elevation view of the squeeze-bottle of FIG. 1, taken along section line 3—3 of FIG. 1.

In the embodiment shown in FIGS. 1-3, stepped tube 70 has an uppermost flange 72 and a first cylindrical surface 74. First cylindrical surface 74 is sized to interference fit stepped tube 70 into discharge orifice 24 in finish 124 of squeeze-bottle 22 in an air-tight manner. It also has a secondary cylindrical surface 76 which is smaller than the first cylindrical surface 74 so that it will fit inside the discharge orifice 42 of flexible bag 40. A circumferential groove 80 is provided about the periphery of secondary cylindrical surface 76 and is sized such that an elastic band 50 may be stretched over the neck portion 46 of bag 40 containing discharge orifice 42, sealingly gathering the neck portion of the bag into circumferential groove 80 without the stretched diameter of elastic band 50 exceeding the diameter of first cylindrical surface 74.

The particular means employed to sealingly secure discharge orifice 42 of bag 40 about secondary cylindrical surface 76 of hollow stepped tube 70 is non-critical, provided the particular means selected does not exceed the cross-section of first cylindrical surface 74, e.g., adhesives, heat sealing, etc. Maintaining the aforementioned size relationship facilitates easy insertion of the lowermost portion of hollow stepped tube 70 into the discharge orifice 24 in finish 124 of squeeze-bottle 22 with the bag 40 sealingly secured thereto.

Flexible bag 40 is preferably comprised of a thin plastic film, preferably having a thickness from about 0.5 to about 5.0 mils thick, and even more preferably from about 1.0 to about 2.5 mils thick. The bag's wall thickness is limited primarily by stiffness and cost considerations. When inserted into squeeze-bottle 22 through the discharge 24 in finish 124, the flat bag 40 is preferably folded or otherwise gathered. Expansion of the folded or wrinkled bag 40 inside the preferred oval shaped squeeze-bottle 22 is readily achieved by injecting a low pressure gaseous pulse through hollow stepped tube 70 when the bag wall thickness is less than about 5.0 mils.

Minimizing the bag's thickness will, of course, provide maximum economy from a cost of materials standpoint. Quite unexpectedly, however, there appears to be a relationship between lower bag wall thickness and higher levels of residual fluid which cannot be removed from the bag at the end of the dispenser's life cycle. Therefore, the lower limit on bag wall thickness may, as a practical matter, be a compromise between maximum fluid removal capability and minimum cost of the bag material.

To construct preferred flat flexible bags 40 of the present invention two layers of film or one layer of film folded upon itself are first fin-sealed in the flat, preferably by heat fusion, and then trimmed to the desired shape. The resulting fin-sealed perimeter 44 shown in FIGS. 2 and 3 is shaped to enable flexible bag 40 to be expanded within squeeze-bottle 22 of dispenser 20 such that the outermost surfaces of bag 40 will substantially coincide with and contact the inside surfaces of flexible squeeze-bottle 22. When the collapsed flexible bag 40 is fully expanded within squeeze-bottle 22, the internal volume of bag 40 preferably approaches at least about 90 percent of the available volume inside squeeze-bottle 22.

In order for flexible bag 40 to be fully expanded within an oval squeeze-bottle 22, flexible bag 40 is preferably oriented upon insertion so that its flat plane is substantially aligned with the major axis 36 of squeeze-bottle 22 during the bag and stepped tube insertion process. If desired, a pair of complementary guides, such as a raised boss and a complementary keyway (not shown) can be provided on first cylindrical surface 74 of hollow stepped tube 70 and on the interior of the discharge orifice 24 of squeeze-bottle 22, respectively, to ensure consistent alignment of the flat plane of bag 40 with the major axis 36 of oval squeeze-bottle 22. The particular alignment system employed in the practice of the present invention is non-critical, provided it does not adversely affect the atmospheric seals which must be established at various locations within the dispenser.

The viscosities of fluids normally used in bag-in-squeeze-bottle dispensers of the present invention typically range from about 100 cps to about 1000,000 cps; most typically from about 3,000 cps for shampoos to about 30,000 cps for beauty fluids.

To ensure that such fluids are maintained at the discharge orifice of the dispenser in a condition ready to dispense at all times, a one-way product discharge valve may be installed to substantially prevent outside air from being sucked back into the bag 40 after fluid flow from the dispenser terminates and the squeezing force applied to the resiliently deformable sidewalls 122 of squeeze-bottle 22 is released. The need for such a valve depends upon the discharge opening design of the dispenser and the resistance of the fluid to flow. Such a fluid discharge valve is particularly beneficial for lower viscosity fluids.

In FIG. 2 a preferred fluid product discharge valve is shown as 90. Valve 90 is what is commonly known in the art as a "duckbill" valve. Duckbill valve 90 is shown inserted between plug 100 and hollow stepped tube 70. As can be seen more clearly in FIGS. 2-4, duckbill valve 90 is assembled partially inside cylindrical plug 100, which in turn is sealingly secured inside bore 88 of hollow stepped tube 70, as by an interference fit. Plug 100 thereby helps to establish a resilient seal between flange 94 on duckbill valve 90 and fluid passage 86 in stepped tube 70. The discharge end 92 of duckbill 90 is inside and adjacent the discharge opening 30 of plug 100. Product discharge valve 90 will permit fluid to pass through its discharge end 92 when the resiliently deformable sidewalls 122 of squeeze-bottle 22 are squeezed, but will substantially prevent air from being drawn back inside flexible bag 40 when the squeezing force is removed from resiliently deformable sidewalls 122.

A one-way vent valve 32 is preferably installed in the shoulder of squeeze-bottle 22 to admit air from the atmosphere into the area between flexible bag 40 and squeeze-bottle 22 to compensate for any dispensed fluid. The one-way feature allows air pressure to be developed inside squeeze-bottle 22 when it is squeezed. In the illustrated embodiment one-way vent valve 32 also comprises a standard flanged rubber duckbill valve which preferably fits into an aperture 38 in the shoulder of squeeze bottle 22.

Valve 32 is preferably interference fit into hole 38 in the shoulder of squeeze-bottle 22 to form a seal therewith so that its discharge end 34 is inwardly oriented, i.e., so that atmospheric air will enter squeeze-bottle 22 when the squeezing force is removed form resiliently deformable sidewalls 122. If the interference fit does not establish a seal, valve 32 can be adhesively bonded at hole 38, with silicone adhesive for example. For the attachment of valve 32 to be air-tight, the shoulder of squeeze-bottle 22 should experience minimum deformation when the squeeze-bottle's resiliently deformable sidewalls 122 are deflected. There are many other venting alternatives possible, such as a flapper valve or umbrella valve in the bottom of the squeeze-bottle 22 or even a ball check valve in an independent passageway through stepped tube 70. Such one-way vent valves are well known in the art.

The vent valve can also be eliminated altogether and a simple aperture provided in one of the resiliently deformable sidewalls 122 of squeeze-bottle 22. In the latter instance the user merely covers the hole with a finger when the bottle is squeezed to generate pressure within the bottle. Uncovering the hole when the squeezing force is removed vents the space between the squeeze-bottle 22 and flexible bag 40 to atmosphere.

FIG. 3 is a cross-section of the assembled dispenser embodiment 20 shown in FIG. 1. Flexible bag 40 is shown fully expanded within oval squeeze-bottle 22. Flexible bag 40 is sealingly secured by elastic band 50 to hollow stepped tube 70, which in turn is sealingly seated into the discharge orifice 24 in finish 124 of squeeze-bottle 22. Flexible bag 40 is shown in FIG. 3 filled with fluid 150 to be dispensed.

Axially secured within hollow stepped tube 70 is an extruded flexible plastic helix 60. Flexible plastic helix 60 helps to prevent flexible bag 40 from collapsing not only at the entrance to the bag's discharge orifice 42 which abuts fluid passageway 86 in hollow stepped tube 70, but substantially all along its length, which extends substantially to the bottom of flexible bag 40.

Figure 4:
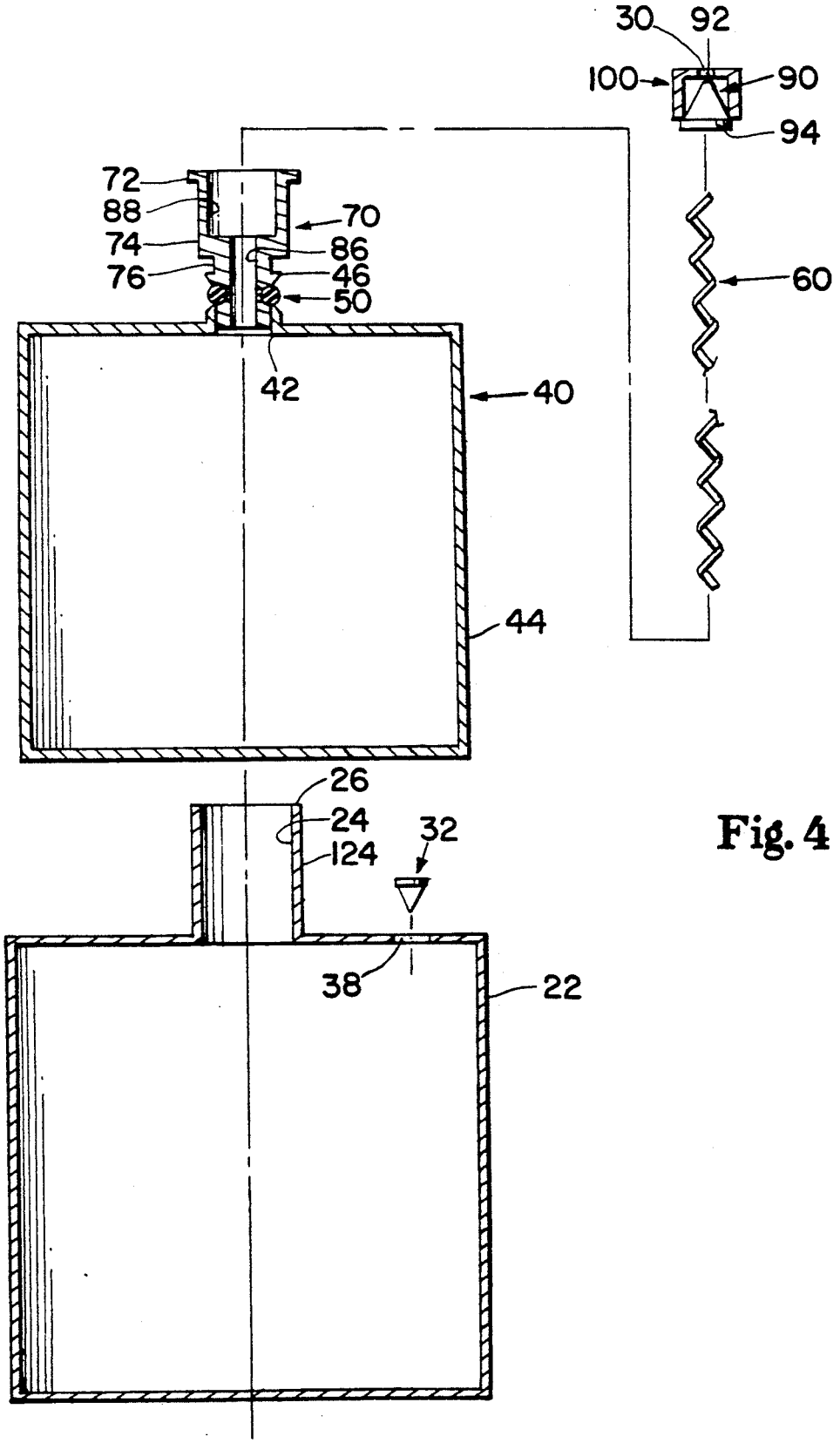
FIG. 4 is a greatly simplified schematic, partially exploded cross-sectional elevation view of the various components shown in FIG. 2.

FIG. 4 is a cross-sectional, partially exploded view of the components comprising bag-in-squeeze-bottle dispenser 20 shown in FIGS. 1-3.

when uppermost flange 72 of hollow stepped tube 70 seats against the uppermost surface 26 of the finish 24 of squeeze-bottle 22 flexible bag 40 reaches its preferred axial position inside the squeeze-bottle 22. Then 2 and 3 psig compressed air is preferably applied to fluid passage 86 in stepped tube 70 in order to fully expand the folded or collapsed flexible bag 40 within squeeze-bottle 22. As flexible bag 40 expands, the displaced air between the interior of squeeze-bottle 22 and flexible bag 40 escapes to the atmosphere through hole 38 in squeeze bottle 22.

One-way vent valve 32 is sealingly secured in hole 38 in squeeze bottle 22 after the folded or collapsed flexible bag 4- has been fully expanded within squeeze bottle 22 to avoid trapping air in the space between flexible bag 40 and squeeze bottle 22, as this would interfere with expansion of the bag.

Once expanded, flexible bag 40 may be filled with fluid 150 through fluid passage 86 in stepped tube 70. After flexible bag 40 is filled, extruded plastic helix 60, which is axially slidable within fluid passage 86 in stepped tube 70, is inserted until its lowermost end approaches the bottom of the filled flexible bag 40.

Plug 100, with fluid discharge valve 90 preassembled into it, may thereafter be pressed into the bore 88 of stepped tube 70 to form a seal therewith and complete the assembly of dispenser 20. Flange 94 of resilient duckbill valve 90 provides an airtight resilient seal with fluid passage 86 in stepped tube 70 when sandwiched between plug 100 and stepped tube 70, as generally shown in FIG. 3. a closure (not shown) is normally applied to complete the manufacturing process and to ready the filled dispenser 20 for shipment to the end user.

Insertion of plug 100 and discharge valve 90 into bore 88 of stepped tube 70 also secures the axially slidable internal bag support member comprising helix 60 in substantial axial alignment with the discharge end of dispensing package 20. The bottom of the flexible bag 40 prevents the helix 60 from becoming downwardly dislodged from fluid passage 86 in stepped tube 70, while plug 100 and valve 90 prevent it from becoming upwardly dislodged from fluid passage 86 in stepped tube 70.

Figure 5:
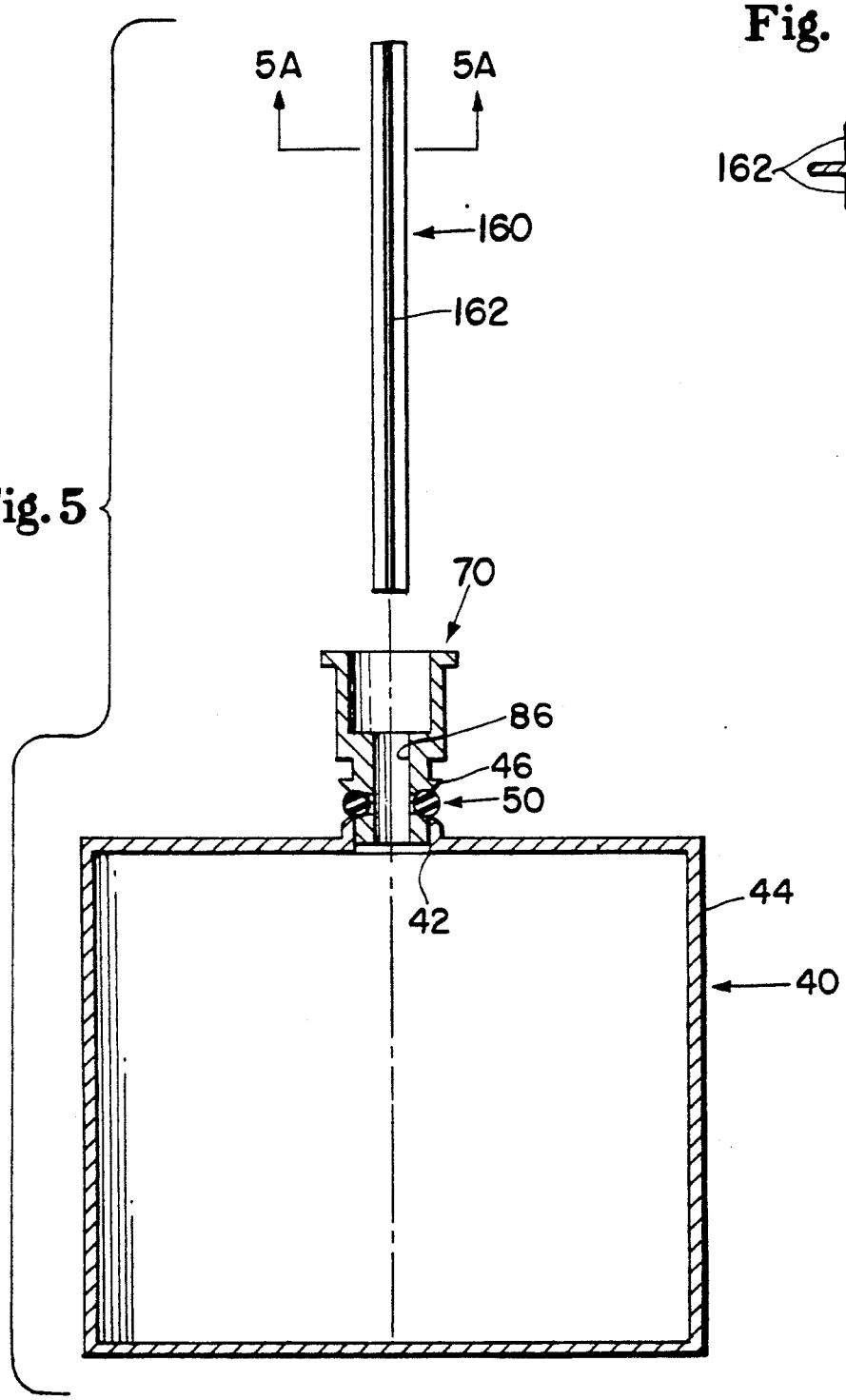
FIG. 5 is a greatly simplified schematic, partially exploded, cross-sectional elevation view of an alternative construction for the internal bag support means for resisting bag collapse which may be employed with flexible bags of the type disclosed in FIGS. 2–4.
Figure 6:
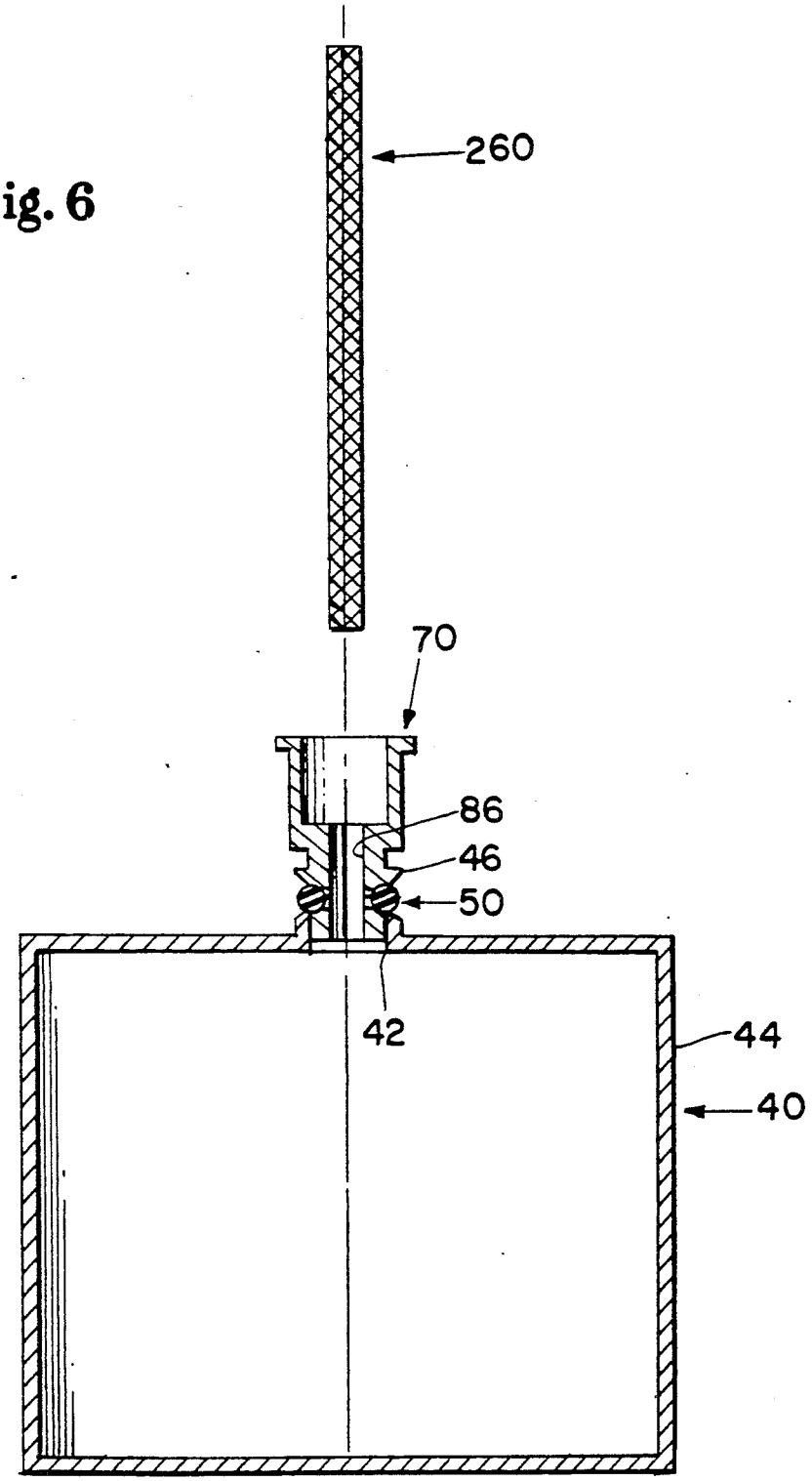
FIG. 6 is a greatly simplified schematic, partially exploded, cross-sectional elevation view of another alternative construction for the internal bag support means for resisting bag collapse which may be employed with flexible bags of the type disclosed in FIGS. 2–4.
Figure 7:
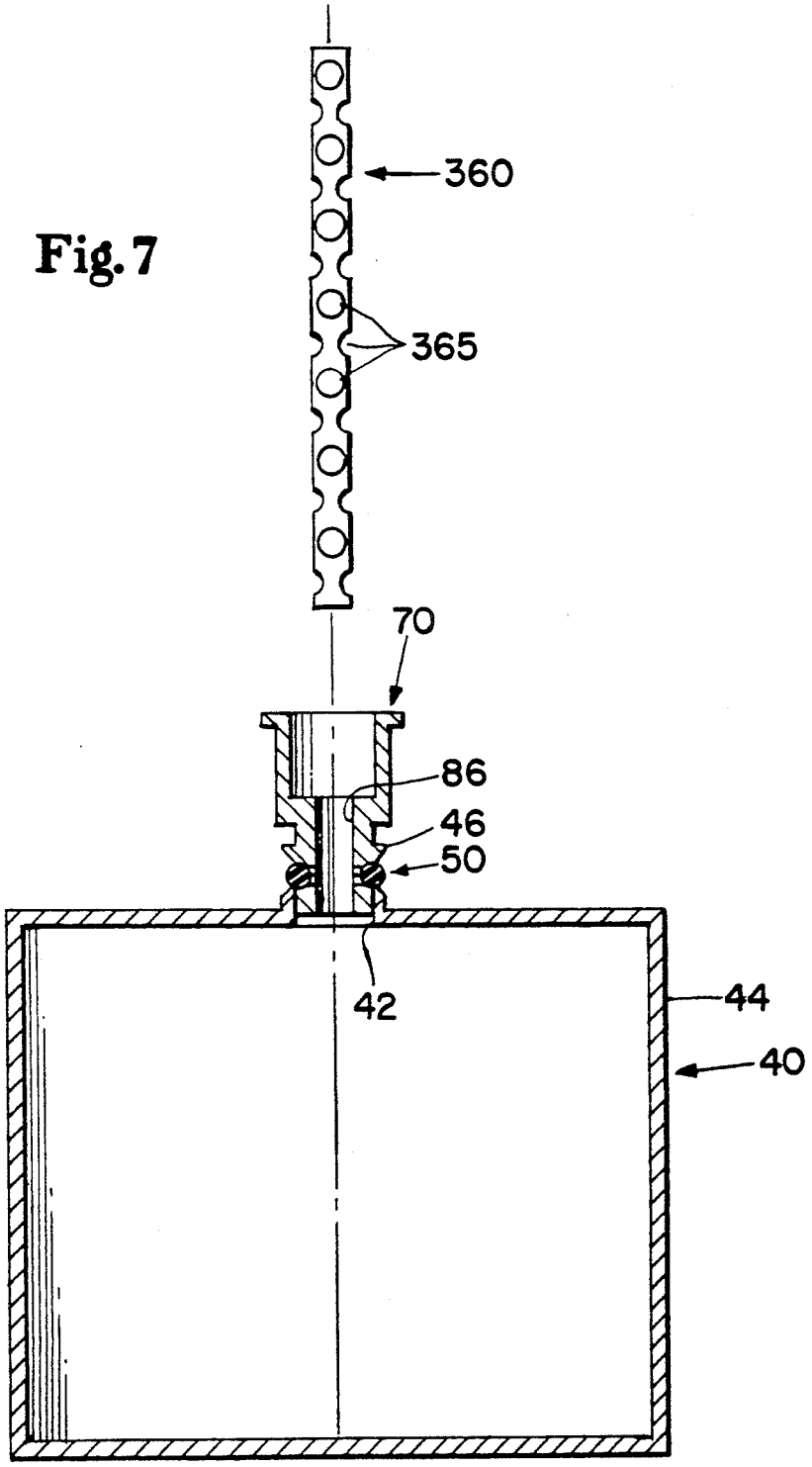
FIG. 7 is a greatly simplified schematic, partially exploded, cross-sectional elevation view of still another alternative construction for the internal bag support means for resisting bag collapse which may be employed with flexible bags of the type disclosed in FIG. 2–4.

Referring now to FIGS. 5, 6 and 7, alternative internal bag support constructions are shown. The remaining components of the dispenser are identical to those described in conjunction with FIGS. 1-4. Accordingly, only the subassembly comprising flexible bag 40, stepped tube 70 and elastic band 50, which is identical to the corresponding subassembly shown in FIG. 4, and various alternative embodiments of the internal bag support means which are ultimately inserted into the flexible bag 40 after the dispenser has been filled with fluid are shown in FIGS. 5, 6 and 7.

FIG. 5 shows a subassembly comprising flexible bag 40 sealingly secured to a hollow stepped tube 70 in a manner identical to that shown and described in connection with dispenser 20 shown in FIGS. 1-4. The subassembly is inserted into squeeze-bottle 22 (not shown in FIG. 5) which is also identical to that shown in FIGS. 1-4. However, after the flexible bag 40 has been filled with the particular fluid to be dispensed, an internal bag support member comprising a spline 160 is inserted through fluid passage 86 in stepped tube 70 and into flexible bag 40.

Figure 5A:
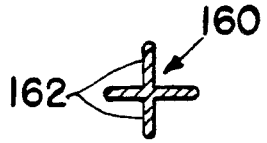
FIG. 5A is a greatly simplified schematic cross-sectional view of the internal bag support means shown in FIG. 5, said view being taken along section line 5A—5A of FIG. 5.

Spline 160 preferably comprises a flexible extruded plastic cross-shaped piece having four perpendicular radial webs 162 extending from a central cylindrical portion, as shown in the cross-section of FIG. 5A. The radially extending webs 162 act to prevent collapse of flexible bag 40 in a manner generally similar to that described in connection with the flexible plastic helix 60. Between each radial web 162 is a channel which permits fluid to reach fluid passage 86 in stepped tube 70 from any point along the length of the spline.

If desired, the splines employed on internal support member 160 can be non-linear along the length of the spline, e.g., they may be twisted for form a continuous helix.

Alternative splines may have more or fewer radial webs and consequently more or fewer corresponding channels along their length.

Spline 160, like helix 60 shown in FIGS. 2–4, has a length which always maintains one of its ends axially secured within fluid passage 86. Axial movement of spline 160 is limited by the bottom of flexible bag 40 at one end and by the plug 100 and discharge valve 90 at the other end.

FIG. 6 shows another subassembly of the present invention wherein a flexible bag 40 is sealingly secured to a hollow stepped tube 70 in a manner identical to that shown and described in connection with dispenser 20 of FIGS. 1–4. The internal bag support means disclosed in FIG. 6 comprises an extruded plastic scrim tube 260 which can be slid axially into the fluid passage 86 in stepped tube 70 after filling of flexible bag 40.

Scrim tube 260 is preferably cut from a continuously formed tube of filaments extruded from counterrotating dies. The open area of scrim tube 260 may be varied by the process through a range estimated at from about 20 percent to about 80 percent. In general, the higher the open area of the scrim the more flexible will be the scrim. The practical upper limit on open area is believed to be just short of the point at which the scrim tube may be completely collapsed upon itself when the resiliently deformable sidewalls 122 of squeeze-bottle 22 are squeezed.

FIG. 7 shows yet another subassembly of the present invention wherein a flexible bag 40 is sealingly secured to a stepped tube 70 in a manner identical to that described in connection with dispenser 20 shown in FIGS. 1–4. The internal support means disclosed in FIG. 7 comprises a perforated conduit which can be slid axially into the fluid passage 86 in stepped tube 70 after filling of flexible bag 40. Perforated conduit 360 preferably comprises an extruded plastic tube with holes 365 mechanically punched in the tube wall from at least two different angles.

Alternative perforated conduits may have widely differing open areas, depending on the viscosity of the fluid to be dispensed and the geometry and stiffness of flexible bag 40. A particularly preferred conduit comprises a plastic straw with 0.31 inch outside diameter and 0.28 inch internal diameter having 0.25 inch diameter holes punched every 0.5 inches along its length, staggered at 90° to each other. It has an open area of about 20 percent.

In general, it has been observed that the fewer the number of perforations in the conduit, the greater will be the volume of residual fluid left in the dispenser at the end of its useful life.

Figure 8:
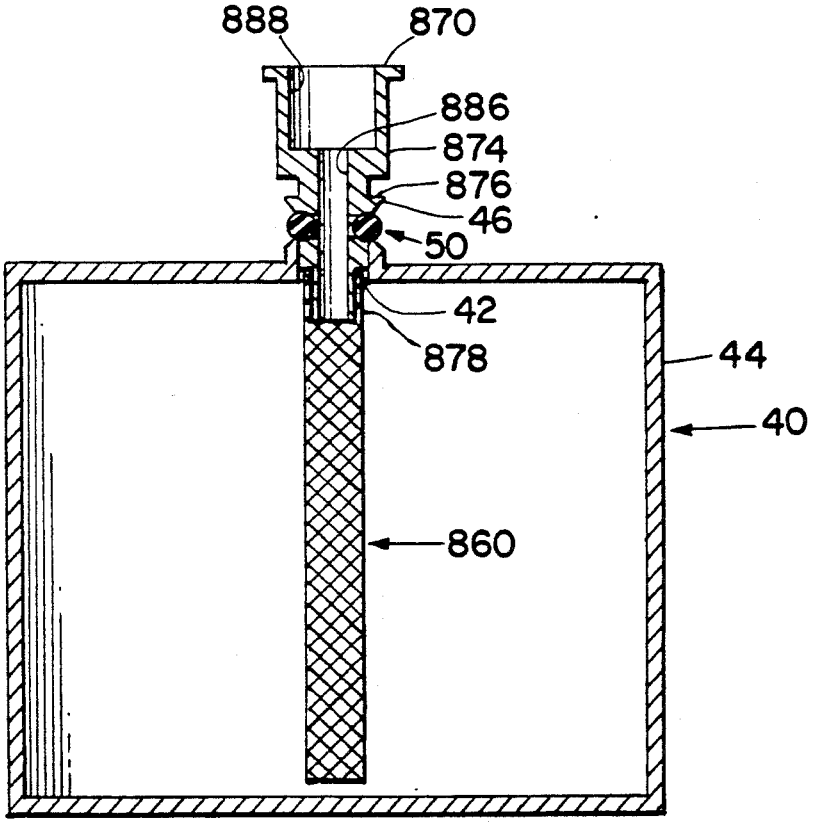
FIG. 8 is a greatly simplified schematic, cross-sectional elevation view of still another alternative construction for the internal bag support means for resisting bag collapse which may be employed with flexible bags of the type disclosed in FIGS. 2–4.

FIG. 8 discloses still another embodiment of internal bag support means which may be employed to resist premature collapse of flexible bag 40 during the dispensing cycle. The subassembly shown in FIG. 8 may be substituted for any of the subassemblies shown in FIGS. 5, 6 or 7 for use in the dispenser 20 shown in FIGS. 1–4.

The flexible bag 40, having discharge orifice 42 secured by an elastic ring 50 in a groove on stepped tube 870 are identical to the correspondingly numbered elements shown in FIGS. 5, 6 and 7. However, stepped tube 870 differs from stepped tube 70 in one principle respect. Namely, it includes a third cylindrical portion 878 depending from secondary cylindrical portion 876, as generally shown in FIG. 8. Fluid passageway 886 in stepped tube 870 extends through cylindrical portions 874, 876 and 878, as generally shown in FIG. 8

The third cylindrical portion 878 of stepped tube 870 can be employed to mount the internal bag support means 860, such as the extruded plastic scrim 860 shown in FIG. 8. The inside diameter of the internal bag support means 860 is preferably sized so that the external surface of third cylindrical portion 878 will securely engage the support means 860. Alternatively, adhesives, heat seals or mating mechanical elements may be employed to secure the bag support means 860 to the cylindrical portion 878 of stepped tube 870.

As will be appreciated, a spiral plastic helix or an apertured conduit could easily be substituted for the scrim illustrated in FIG. 8.

The subassembly illustrated in FIG. 8 differs from the subassemblies illustrated in FIGS. 5, 6 and 7 in that the internal bag support means is not slidably secured within the discharge orifice of the flexible bag 40 or plastic bottle 22.

Accordingly; the internal support means 860 is inserted along with the collapsed bag 40 through the discharge orifice 24 of squeeze-bottle 22 and the bag is thereafter expanded. Filling of the bag with fluid product is performed with the internal bag support means 860 in place in the embodiment shown in FIG. 8.

As pointed out earlier herein, the particular means employed to secure the discharge orifice of flexible bag 40 in sealed relation to the discharge orifice 24 of squeeze-bottle 22 is non-critical. Accordingly, it is also possible in the practice of the present invention to sealingly secure the discharge orifice 42 of flexible bag 40 across the discharge orifice 24 in squeeze-bottle 22 without employing a stepped tube such as 70 or 870. If desired, the flexible bag may thereafter be filled with fluid product and the internal support means thereafter inserted through the discharge orifice 42 of the filled bag 40. In the latter situation, it is generally preferred that some type of structure comparable to stepped tube 70 or 870 be employed to permanently secure the discharge orifice 42 of bag 40 in sealed relation to the discharge orifice 24 in squeeze-bottle 22, as by a compression fit. If an orifice securement structure comparable to stepped tube 70 is employed for this purpose, the internal bag support means can be inserted as an independent operation. Alternatively, if an orifice securement structure comparable to stepped tube 870 is employed, the internal bag support means is preferably secured thereto prior to insertion of the orifice securement structure into the discharge orifice 42 of flexible bag 40.

Whatever method of assembly is selected for the internal bag support means, flexible bag and squeeze bottle, the remainder of the assembly operation may be identical to that described in connection with dispenser embodiment 20 illustrated in FIGS. 1–4, i.e., plug 100 containing one-way product discharge valve 90 may be press fit into counter bore 888 of stepped tube 870.

SAMPLE BAG-IN-SQUEEZE-BOTTLE PACKAGE

In constructing a sample embodiment of the present invention a 6 oz. transparent polyvinyl chloride "special oval" squeeze-bottle with a #24-415 finish having a discharge orifice 24 measuring approximately 0.69 inches in diameter and measuring approximately 2.38 inches about its major axis 36 by about 1.25 inches along its minor axis 34 was obtained from Owens Brockway of Toledo, Ohio to serve as a squeeze bottle 22. The average wall thickness of the squeeze bottle's resiliently deformable sidewalls 122 was about 0.020 inches. The squeeze bottle 22 exhibited a 1.9 major/minor axis ration and a dimension of about 5.25 inches from its base to the start of its shoulder. It was about 6.5 inches tall overall.

Hollow stepped tube 70, which was machined from polycarbonate, was about 1.44 inches long. First cylindrical surface 74 of stepped tube 70 exhibited a 0.725 inch diameter; second cylindrical surface 76 of stepped tube 70 exhibited a 0.60 inch diameter; groove 80 was about 0.19 inches wide and exhibited a 0.42 inch root diameter; bore 88 of stepped tube 70 exhibited a 0.560 inch diameter; and fluid passage 86 in stepped tube 70 exhibited a 0.33 inch diameter.

Flexible bag 40 was comprised of 1.25 mil thick low density polyethylene film.

Elastic band 50 comprised a 0.50 inch outside diameter by 0.30 inch inside diameter latex Elastrator Ring #C233N, as available from NASCO Farm & Ranch of Fort Atkinson, Wisconsin. Rubber duckbill valves 90 and 32 were comprised of rubber valves #VL196-145 and #VL1735-101, respectively, as available from Vernay Laboratories, Inc. of Yellow Springs, Ohio. Flexible plastic helix 60 comprised a 0.06 inch diameter polypropylene extrusion, with a helix inside diameter of about 0.19 inches, a helix outside diameter of approximately 0.31 inches, a helix pitch of approximately 0.16 inches and an overall length of approximately 5.75 inches. Plug 100 exhibited a discharge opening 30 measuring approximately 0.25 inches in diameter. Upon insertion, plug 100 helped to establish a resilient seal between the flange 94 in duckbill valve 90 and fluid passage 86 in stepped tube 70.

The construction of the bag-in-squeeze-bottle package was generally in accordance with that shown in FIGS. 1–4.

The resultant dispenser 20 was filled prior to insertion of the helix 60 with approximately 148 milliliters of Press® Hair Conditioner having a specific gravity substantially equal to that of water and a viscosity of about 3000 cps. The valve 90 and plug 100 were thereafter inserted. The dispenser was thereafter successively actuated by squeezing its side walls 122 until it no longer dispensed any fluid when squeezed. When disassembled, a residual of approximately 9 milliliters of product remained within the support helix 60 and flexible bag 40. Thus, approximately 94 percent of the fluid product was successfully and reliably dispensed over the dispenser's useful life.

It is believed that the bag-in-squeeze-bottle dispenser of the present invention, and many of its attendant advantages, will be readily understood from the foregoing description. Various changes may be made to its form, construction and arrangement without departing from the spirit and scope of the invention or sacrificing of its operational advantages, the forms hereinbefore described being merely preferred or exemplary embodiments thereof.

What is claimed is:

1. A bag-in-squeeze-bottle fluid dispenser for fluid products, said dispenser being capable of dispensing substantially all of the fluid product contained therein, said dispenser comprising:

(a) a squeeze bottle having at least one resiliently deformable sidewall, said bottle including a discharge orifice;

(b) a fluid-containing flexible bag housed within said squeeze bottle, said flexible bag also having a discharge orifice;

(c) a substantially rigid housing adapted to sealingly attach the discharge orifice of said flexible bag to the discharge orifice of said squeeze bottle, said housing having a passage providing fluid communication from the discharge orifice of the flexible bag through the discharge orifice of said squeeze bottle;

(d) vent means in communication with the space between said squeeze bottle and said flexible bag, said vent means being capable of forming a seal to the atmosphere to permit the application of air pressure to said flexible bag when said resiliently deformable sidewall on said squeeze bottle is squeezed and venting said space between said bottle and said flexible bag to the atmosphere when said resiliently deformable sidewall is released;

(e) a one-way fluid product discharge valve secured within said passage, said fluid product discharge valve substantially preventing air from being sucked bach into the bag when the squeezing force is removed from said resiliently deformable sidewall; and (f) internal means for supporting said flexible bag having an internal fluid passage and means for fluid contained within said bag to access said internal fluid passage along substantially the entire length of said internal bag support means to substantially prevent said flexible bag from collapsing and blocking the passage of fluid remaining in said bag through the discharge orifice in said bag until substantially all of the fluid contained in said bag has been dispensed, said internal bag support means being adapted to be inserted into said flexible bag through said passage of said substantially rigid housing such that said internal bag support means is unsealingly held in said housing passage between the fluid product discharge valve and the opposite end of said flexible bag.

2. The bag-in-squeeze-bottle fluid dispenser of claim 1, wherein said internal bag support means comprises a flexible tubular member.

3. The bag-in-squeeze-bottle dispenser of claim 2, wherein said flexible tubular member comprises an extruded plastic scrim.

4. The bag-in-squeeze-bottle dispenser of claim 2, wherein said flexible tubular member comprises an apertured plastic conduit.

5. The bag-in-squeeze-bottle fluid dispenser of claim 1, wherein said vent means comprises a one-way valve.

6. The bag-in-squeeze-bottle dispenser of claim 5, wherein said one-way valve comprising said vent means comprises a rubber duckbill valve.

7. The bag-in-squeeze-bottle fluid dispenser of claim 1, wherein said internal bag support means comprises a flexible helix.

8. The bag-in-squeeze-bottle dispenser of claim 1, 2, 3 or 4, wherein said internal bag support means is secured in axially slidable relation to the discharge orifice of said squeeze bottle and the discharge orifice of said fluid-containing bag.

9. A bag-in-squeeze-bottle fluid dispenser for fluid products, said dispenser being capable of dispensing substantially all of the fluid product contained therein, said dispenser comprising:

(a) a squeeze bottle having at least one resiliently deformable sidewall, said bottle including a discharge orifice;

(b) a fluid-containing flexible bag housed within said squeeze bottle, said flexible bag also having a discharge orifice;

(c) a substantially rigid housing adapted to sealing attach the discharge orifice of said flexible bag to the discharge orifice of said squeeze bottle, said housing having a passage providing fluid communication from the discharge orifice of the flexible bag through the discharge orifice of said squeeze bottle;

(d) vent means in communication with the space between said squeeze bottle and said flexible bag, said vent means being capable of forming a seal to the atmosphere to permit the application of air pressure to said flexible bag when said resiliently deformable sidewall on said squeeze bottle is squeezed and venting said space between said bottle and said flexible bag to the atmosphere when said resiliently deformable sidewall is released;

(e) a one-way fluid product discharge valve secured within said passage, said fluid product discharge valve substantially preventing air from being sucked back into the bag when the squeezing force is removed from said resiliently deformable sidewall; and (f) internal means for supporting said flexible bag having an internal fluid passage and means for fluid contained within said bag to access said internal fluid passage along substantially the entire length of said internal bag support means to substantially prevent said flexible bag from collapsing and blocking the passage of fluid remaining in said bag through the discharge orifice in said bag until substantially all of the fluid contained in said bag has been dispensed, said internal bag support means being adapted to be inserted into said flexible bag through said passage of said substantially rigid housing such that said internal bag support means is unsealingly held in said housing passage between the fluid product discharge valve and the opposite end of said flexible bag after said bag has been filled with the fluid to be dispensed.

10. The bag-in-squeeze-bottle fluid dispenser of claim 9, wherein said internal bag support means comprises a flexible tubular member.

11. The bag-in-squeeze-bottle dispenser of claim 10, wherein said flexible tubular member comprises an extruded plastic scrim.

12. The bag-in-squeeze-bottle dispenser of claim 10, wherein said flexible tubular member comprises an apertured plastic conduit.

13. The bat-in-squeeze-bottle fluid dispenser of claim 9, wherein said vent means comprises a one-way valve.

14. The bag-in-squeeze-bottle dispenser of claim 13, wherein said one-way valve comprising said vent means comprises a rubber duckbill valve.

15. The bag-in-squeeze-bottle fluid dispenser of claim 9 wherein said one-way product discharge valve comprises a rubber duckbill valve.

16. The bag-in-squeeze-bottle fluid dispenser of claim 9, wherein said internal bag support means comprises a flexible helix.

17. The bag-in-squeeze-bottle dispenser of claim 16, 10, 11 or 12, wherein said internal bag support means is secured in axially slidable relation to the discharge orifice of said squeeze bottle and the discharge orifice of said fluid-containing bag.

18. A method of producing a bag-in-squeeze-bottle fluid dispenser for fluid products, said dispenser being capable of dispensing substantially all of the fluid product contained therein, said method comprising the steps of:

(a) forming a squeeze bottle having at least one resiliently deformable sidewall and a discharge orifice;

(b) inserting a collapsed flexible bag having a discharge orifice within said squeeze bottle by passing it through the discharge orifice of said squeeze bottle;

(c) expanding said collapsed flexible bag within said squeeze bottle while venting the space between said squeeze bottle and said flexible bag to atmosphere;

(d) inserting a substantially rigid housing having a passage to provide fluid communication from the discharge orifice of said flexible bag through the discharge orifice of said squeeze bottle, such that the discharge orifice of said flexible bag is sealed across the discharge orifice of said squeeze bottle;

(e) filling said expanded flexible bag with the fluid product to be dispensed;

(f) inserting through said passage of said substantially rigid housing an internal means for supporting said flexible bag having an internal fluid passage and means for fluid contained within said bag to access said internal passage along substantially the entire length of said internal bag support means to substantially prevent said flexible bag from collapsing and blocking the passage of fluid remaining in said bag through the discharge orifice in said bag until substantially all of the fluid contained in said bag has been dispensed, said internal support the means being inserted such that the internal means extends from the passage of said substantially rigid housing to a point substantially coinciding with the opposite end of said flexible bag; and (g) securing in said passage of said substantially rigid housing a one-way fluid product valve such that said internal means is unsealingly held in said housing passage between the fluid product discharge valve and the opposite end of said flexible bag.

19. The method of claim 18, further including the step of:

(g) providing one-way vent means in communication with the space between said squeeze bottle and said flexible bag, said vent means being capable of forming a seal to the atmosphere to permit the application of air pressure to said flexible bag when said resiliently deformable sidewall on said squeeze bottle is squeezed and venting said space between said bottle and said flexible bag to the atmosphere when said resiliently deformable sidewall is released.

20. The method of claim 10, wherein the step of providing one-way vent means in communication with the space between said squeeze bottle and said flexible bag comprises sealingly securing a one-way valve in an aperture located in said squeeze bottle, said one-way valve being oriented so that it is capable of allowing atmospheric air to enter the space between said squeeze bottle and said flexible bag when the squeezing force is released from said resiliently deformable sidewall of said squeeze bottle, yet prevent atmospheric air from escaping from said space when said resiliently deformable sidewall is squeeze.

21. The method of claim 18, wherein said internal bag support means is secured in axially slidable relation to the discharge orifice of said squeeze bottle and the discharge orifice of said flexible bag.

22. The method of claim 18, wherein said collapsed flexible bag is expanded within said squeeze bottle by applying gas pressure within said bag through its discharge orifice.

* * * * *

UNITED STATES PATENT AND TRADEMARK OFFICE

CERTIFICATE OF CORRECTION

PATENT NO. : 5,156,300

DATED : October 20, 1992

INVENTOR(S) : MILTON D. SPAHNI, RONALD W. KOCK, CHARLES G. YEAZELL AND ROBERT C. JOHNSON

It is certified that error appears in the above-identified patent and that said Letters Patent is hereby corrected as shown below:

Column 7, line 22, "Which" should read -- which --.

Column 10, line 14, "4-" should read -- 40 --.

Column 10, line 31, "a" should read -- A --.

Column 15,

Claim 8, line 1, "1, 2, 3" should read -- 2, 3, 4 --.

Claim 8, line 2, "4" should read -- 7 --.

Column 16,

Claim 20, line 67, "10" should read -- 19 --.

Signed and Sealed this

Sixteenth Day of November, 1993

*Attest:*

*Attesting Officer*

Bruce Lehman

BRUCE LEHMAN

*Commissioner of Patents and Trademarks*